US010272306B2

(12) United States Patent
McDaniel

(10) Patent No.: US 10,272,306 B2
(45) Date of Patent: Apr. 30, 2019

(54) TABLE TENNIS PADDLE

(71) Applicant: Donald Wesley McDaniel, El Cajon, CA (US)

(72) Inventor: Donald Wesley McDaniel, El Cajon, CA (US)

( * ) Notice: Subject to any disclaimer, the term of this patent is extended or adjusted under 35 U.S.C. 154(b) by 0 days.

(21) Appl. No.: 15/725,111

(22) Filed: Oct. 4, 2017

(65) Prior Publication Data

US 2019/0099646 A1 Apr. 4, 2019

(51) Int. Cl.

*A63B 59/42* (2015.01)
*A63B 60/34* (2015.01)
*A63B 60/12* (2015.01)

(52) U.S. Cl.

CPC ..... *A63B 60/34* (2015.10); *A63B 59/42* (2015.10); *A63B 60/12* (2015.10); *A63B 2209/00* (2013.01)

(58) Field of Classification Search

CPC ..... A63B 60/34; A63B 60/06; A63B 60/12; A63B 60/32; A63B 59/40; A63B 59/42; A63B 2209/00

See application file for complete search history.

(56) References Cited

U.S. PATENT DOCUMENTS

D164,883 S * 10/1951 Schmid ..... 473/526
3,545,755 A * 12/1970 Owada ..... A63B 49/00 473/526
3,674,268 A * 7/1972 Shellman, Sr. ..... A63B 59/40 473/526
4,131,278 A * 12/1978 Goldenberg ..... A63B 60/34 473/526
4,147,348 A * 4/1979 Lee ..... A63B 49/08 473/526
5,312,101 A * 5/1994 McDaniel ..... A63B 59/40 473/526
2003/0013564 A1* 1/2003 McDaniel ..... A63B 59/40 473/527
2005/0181895 A1* 8/2005 Popovich ..... A63B 60/34 473/527
2010/0116103 A1* 5/2010 Clancy ..... B25G 1/102 81/489
2010/0317468 A1* 12/2010 Tang ..... A63B 49/08 473/549
2013/0165278 A1* 6/2013 Butterfield ..... A01K 15/025 473/515
2014/0221133 A1* 8/2014 Tillery ..... A63B 59/40 473/527
2015/0224377 A1* 8/2015 Kowalke ..... A63B 59/04 473/527
2018/0015341 A1* 1/2018 Planakis ..... A63B 60/34

FOREIGN PATENT DOCUMENTS

KR 481957 * 12/2016 ..... A63B 59/40
WO WO 9119545 A1 * 12/1991 ..... A63B 60/06
WO WO 2011153934 A1 * 12/2011 ..... A63B 59/40

* cited by examiner

*Primary Examiner* — Raleigh W Chiu

(57) ABSTRACT

A preferred embodiment of a novel paddle for use in racquet sports, and particularly table tennis, is disclosed. The paddle features a handle which is designed to comfortably conform to the players grip, while both enhancing total backhand play and allowing for ease of rotation to forehand play at any time on either side of the body; Thus, a paddle which eliminates ever being caught out of position. The alignment for the attachment of the handle to the blade is what is specifically unique.

3 Claims, 1 Drawing Sheet

TABLE TENNIS PADDLE

BACKGROUND OF THE INVENTION

1. Field of the Invention

This invention relates to structures known as bats, rackets or paddles (hereinafter, "paddles") for use in ball games. It specifically relates to paddles for use in table tennis or ping pong games.

2. History of the Prior Art in most racquet sports, particularly table tennis and ping pong (hereinafter collectively referred to as "table tennis", the paddle consists of a flat paddle surface ("blade") of varying shape attached to, and in the same plane of a handle. As a result of this single plane configuration, any effort to strike a ball so it moves in any direction other than in a perpendicular plane to the player's body, requires the player to twist or bend his or her wrist in proportion to the angle of ball movement which is desired.

In addition, the player's movements are constrained by the need to either rotate the paddle up to 180 degrees or more around the player's body, or to change the hand holding the paddle to allow a backhand shot to be made.

To explain, as opposed to the forehand side of the body, the backhand side is considered to be the one opposite the hand holding the paddle when the player is at rest. Similarly, the backhand side of the paddle is (as opposed to the forehand) that side which faces in the opposite direction of the palm of the hand which holds the paddle. To change play from forehand to backhand, the paddle must be fully rotated around the player's body from its forehand to its backhand side. Not only is this required rotation somewhat awkward to achieve, it also causes the player to lose much of the time available to address the ball to positioning the paddle for play.

Further, the traditional table tennis paddle consists of a substantially cylindrical handle immovably attached to the paddle blade. Except for the possible presence on the handle of cushioning means (such as compressible foam), the handle does not conform to the player's hand. As a result, it can only be gripped by allowing the hand to encompass the handle, leaving the paddle in a substantially perpendicular position with respect to the player's wrist. This particular grip is referred to as the shake hand grip, which is the most used grip in conventional table tennis. As a result, the most comfortable paddle position is not the one best suited for play, thus encouraging fatigue of the player's wrist and hand, in having to tilt the wrist forward to lower the blade to more closely become an extension of the arm.

What is needed, therefore, is a paddle for racquet sports, and particularly for table tennis, which allows the player to comfortably make forehand, backhand, and angled strokes with minimal adjustment of the paddle position.

SUMMARY OF THE INVENTION

In essence, the paddles of this invention consist of two principal structural components which are either formed separately and joined, or molded as a single piece. These components are the blade and handle, which can be made of structural foam, wood or plastic. In the embodiment described, the two structural components are made of wood, and the attachment of the handle to the blade must include each of the following points:

(1) The center line plane of the handle and the plane of the blade are two separate but intersecting planes not to exceed 45 degrees.

(2) The handle contained within its plane is rotated outward and downward from the terminal end attachment line of the handle to the blade, thus allowing the paddle surface to be an extension of the arm rather than perpendicular to the wrist, as is normal with conventional paddles.

(3) The plane of attachment of the handle to the blade lies between the lines of intersection of the planes containing the two parallel sides of the handle with the blade.

(4) The playing surface of the blade extends only forward from the terminal end attachment line of the handle with the blade. This feature allows the same surface area on both sides of the blade for striking the ball.

In addition, the handles are structured to conform to the player's hand and a comfortable wrist position, and further configured to provide for a more secure grip than provided by conventional paddles. The handle has two curvatures along the inner gripping surface separated by an extension of said surface.

DESCRIPTION OF THE PREFERRED EMBODIMENT

Figure 1:
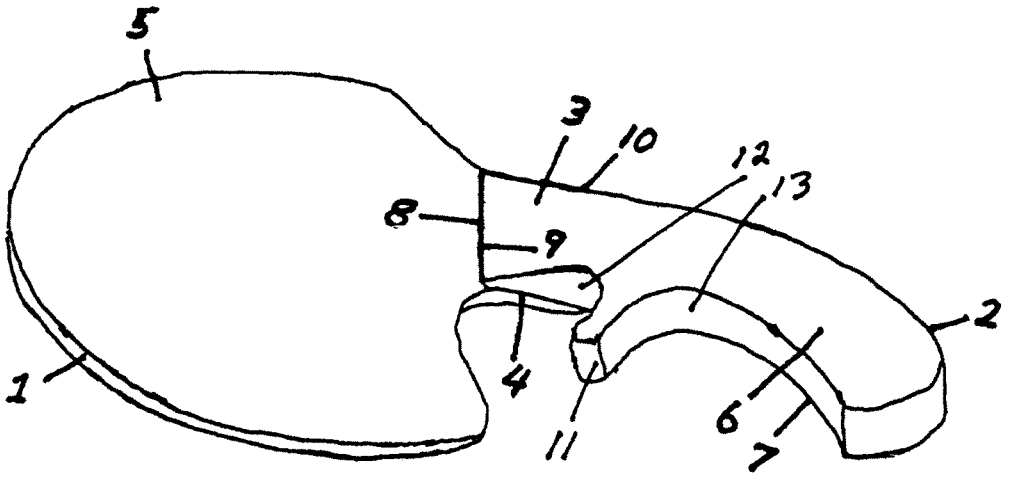
FIG. 1 is a perspective view of a preferred configuration of the paddle.

FIG. 1 depicts one embodiment of the invention paddle in perspective view. In this embodiment, the blade 1 and the handle 2 are separate components. The handle 2 is substantially a curved pistol grip configuration, where the terminal end 9 at the upper extension of the handle 2 is attached by attachment means to the forehand face 5 of the blade 1 along the edge thereof. The forward attachment line 8 is parallel with the terminal end 9 of the side of the handle 2. A left handed paddle would be a mirror image of FIG. 1, the right handed paddle. The center line plane containing the handle 2 and the forehand face 5 of blade 1 are two separate, but intersecting planes not to exceed 45 degrees, with both planes being perpendicular to the floor, best shown in FIG. 2. The handle 2 contained within its plane is rotated outward and downward from the attachment section 4 to the blade 2. The handle 2 is an open handle with only one attachment 4 on the side at the upper end of attachment leg 3. Regardless of the amount of the rise of the handle 2 from the blade 1, based upon the chosen angle of the attachment section 4, the two sides 6 and 7 and the centerline plane of the handle 2 remain parallel with the line of attachment 8, and are perpendicular to the horizontal centerline plane of the wrist and forearm when held in a level position relative to the floor; thus the blade 5 is in a vertical alignment position relative to the floor, but angled inward for optimum play with either side of the paddle. Note: the alignments, as described, allow for an offset handle from the blade, but do not allow for any rotation of the handle relative to the blade; thus, the blade is a perfect extension of the wrist and forearm, as if the fingers were extended forward.

The plane of attachment 4 of the handle 2 to the face of the blade 5 lies between the lines of intersection of the planes containing the two sides 6 and 7 of the handle.

The forehand surface 5 of the blade 1 extends only forward from the terminal end attachment line 8. This feature allows the same surface area on both sides of the blade for striking the ball. The blade may be any number of configurations, but is substantially configured within a 6 inch width by 6 inch height.

Figure 2:
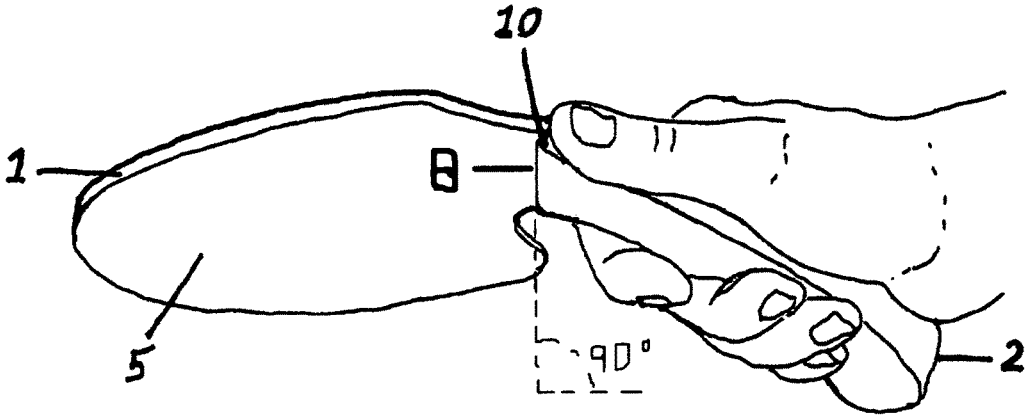
FIG. 2 is a sectional view of FIG. 1, showing the gripping alignment.

FIG. 2 shows the preferred gripping alignment. The gripping of the handle is with the thumb positioned along the upper surface 10 of the handle 2 above the upper end attachment line 4 of the blade to the handle, to allow for greater rotational capability of the paddle.

FIGS. 1 and 2 show the most preferred handle configuration. The most preferred handle configuration for a very secure grip, while allowing the player to have a semi-relaxed hand grip during play, is having two curvatures 12 & 13 along the gripping surface to conform, respectively, to the index finger, and possibly, the middle finger of the player's hand, with the thumb resting along the top surface 10 of the handle instead of being wrapped around the handle, while the second curvature 13 accommodates the remaining fingers of the player's hand. The extension 11 between two of the fingers stabilizes the handle and prevents it from sliding out of position while being held onto lightly.

The angle of attachment of the handle to the blade allows the player to strike the ball with either side of the blade without rotation of his or her grip on the handle regardless of whether the ball approaches the player on the forehand or backhand side, although it is expected that the backhand surface of the blade will be used predominately in play, for top spin, side spin or back spin shots. It should be noted, that the angle of attachment allows for the most comfortable and effective play as it allows the player to use its backhand surface on the forehand side of the body and, conversely, the forehand surface on the backhand side of the body.

The advantage of using the backhand surface of the blade predominately to strike the ball in play is that the response time needed to set up the play by having to rotate the paddle from the backhand to the forehand side, with a conventional paddle, is eliminated. For that reason, the angled handle will enhance backhand play, but will also allow forehand strokes to be utilized to best advantage in strokes requiring the ball to be stroked more forcefully downward onto the table left or right of center.

It will be appreciated by those skilled in the art that modifications can be made to the embodiment of the invention disclosed herein without departing from the spirit or concept of the invention.

I claim:

1. A paddle for use in racquet sports, particularly table tennis, comprising:

A substantially flat blade;

A handle, whose centerline plane lies in a distinctively different, but intersecting plane, ((between 0 degrees and 45 degrees)) not to exceed 45 degrees to the plane of the blade;

((The handle contained within this plane extends outward and downward from the attachment at the upper end to the blade at an angle between 0 degrees and 90 degrees));

The upper, or top surface of the curved handle contained within this plane extends outward and downward from the terminal end attachment line at the forward end of the handle;

The handle has two curvatures along the underside, inner gripping surface separated by an extension of said surface;

The plane of attachment of the handle to the blade lies between the lines of intersection of the two parallel sides of the handle with the blade; and the angle of cut, between the two sides of the handle is between 10 degrees and 45 degrees;

((The two sides and the centerline plane of the handle are parallel to the line of attachment and perpendicular to the horizontal centerline plane of the wrist and forearm when held in a level position relative to the floor;))

The plane containing the flat surface of the blade, and the plane containing the flat side surface of the handle are two intersecting vertical planes, so that the forward leading edge of the side of the handle is perpendicular to the floor when held in the hand with the forearm level or parallel to the floor; the lines of intersection of the plane intersecting the two sides of the handle are also vertical and thus perpendicular to the level forearm and to the floor;

The playing surface of the blade extends only forward from the terminal end attachment of the handle, thus allowing for the same surface area on both sides of the blade.

2. The paddle according to claim 1 wherein the handle and blade are plastic molded in one piece.

3. The paddle according to claim 1 wherein either of the handle and blade is formed of structural foam, plastic or wood.

* * * * *